United States Patent [19]

Hayes

[11] 4,035,202

[45] July 12, 1977

[54] ANNEALING TREATMENT FOR CONTROLLING WARHEAD FRAGMENTATION SIZE DISTRIBUTION

[75] Inventor: George A. Hayes, China Lake, Calif.

[73] Assignee: The United States of America as represented by the Secretary of the Navy, Washington, D.C.

[21] Appl. No.: 514,976

[22] Filed: Oct. 23, 1973

Related U.S. Application Data

[62] Division of Ser. No. 231,429, March 2, 1972, Pat. No. 3,791,881.

[51] Int. Cl.[2] ..... C21D 9/16

[52] U.S. Cl. ..... 148/16; 204/140

[58] Field of Search ..... 204/14 R, 129, 140; 148/6, 6.35, 31.5, 14, 16, 16.5, 16.6; 29/1.2, 1.21; 102/56 R, 64, 67, 68, 91

[56] References Cited

U.S. PATENT DOCUMENTS

| | | | |
|---|---|---|---|
| 1,303,727 | 5/1919 | Rice | 148/2 |
| 1,513,824 | 11/1924 | Kasley | 204/140 |
| 1,759,690 | 5/1930 | Fleckenstein et al. | 148/16.5 X |
| 2,325,079 | 7/1943 | Soderholm | 102/67 X |
| 3,513,038 | 5/1970 | Weil | 148/12.1 X |
| 3,547,032 | 12/1970 | Horvath | 75/123 N |
| 3,676,907 | 7/1972 | Magis | 102/56 X |
| 3,783,790 | 1/1974 | Polcha | 102/67 |

FOREIGN PATENT DOCUMENTS

| | | | |
|---|---|---|---|
| 3,585 | 4/1893 | United Kingdom | 148/19 |

OTHER PUBLICATIONS

Principles of Electroplating and Electroforming, Blum et al., 3rd Ed., 1949, McGraw Hill Co., N.Y., pp. 212 & 213.

Metals Handbook, vol. 2, 8th Ed., 1964, pp. 110 & 111.

*Primary Examiner*—R. Dean

*Attorney, Agent, or Firm*—R. S. Sciascia; Roy Miller; Lloyd E. K. Pohl

[57] ABSTRACT

Methods for controlling the sizes and shapes of fragments produced by warhead casings are disclosed.

1 Claim, No Drawings

ANNEALING TREATMENT FOR CONTROLLING WARHEAD FRAGMENTATION SIZE DISTRIBUTION

This is a division, of application Ser. No. 231,429, filed Mar. 2, 1972, now U.S. Pat. No. 3,791,831.

BACKGROUND OF THE INVENTION

1. Field of the Invention

This invention relates to the manufacture of fragmentation warheads. More particularly, this invention relates to methods for treating the materials from which fragmentation warheads are made in order to control the size and/or shape of the fragments which will be produced by the warheads.

2. Description of the Prior Art

Fragmentation warheads are well known. They are used in military operations both as armor piercing devices and as anti-personnel devices.

In armor piercing applications anything from a thin wooden wall to a reinforced concrete or steel structure may be the target. In this case, it is desirable to have the nose (portion that actually strikes the target) of the warhead be very hard and strong and the body (casing) which follows the nose be formed of material which breaks up into relatively large and preferably incendiary type fragments. Relatively large fragments are desirable in armor piercing applications in order that the fragments have some armor piercing capability themselves.

On the other hand, in anti-personnel applications it is desirable to have the warhead casing break up into a very large number of small, high velocity fragments when the warhead is detonated. The reason for this is self evident if the warhead is thought of as being detonated in the air over a widely dispersed plurality of targets.

Several methods of manufacture have been devised in attempts to control the size and shape of fragments produced by warheads upon detonation. Certain of these methods involve the use of scoring to produce zones of weakness in the warhead casing. When a scored warhead is detonated, the casing is supposed to break in the scored areas. However, due to the violent force of the explosion, such warhead casings often break up into much smaller fragments than planned upon detonation. Furthermore, scoring produces a rough outer surface which impedes the smooth travel of the warhead through air prior to detonation and, for this reason, is undesirable. Still further, scoring is an expensive process.

Other methods used in attempting to control the size and shape of warhead fragments utilize differential heat treatment to provide alternating bands or areas of strength and weakness in the material of the warhead casing. In order to be successful, these methods require the use of very sophisticated apparatus to isolate the areas which are to be heated (tempered) from the areas which are not. Thus, these methods are expensive and, because of the sophisticated nature of the apparatus, sometimes unreliable.

SUMMARY OF THE INVENTION

It has now been found that the average size of fragments produced by a warhead can be controlled by several different methods. Certain of these methods are capable of controlling the shape as well as the average size of fragments. One method involves heating a hardened and strengthened warhead casing to a temperature in the range of from about 400° F to about 1200° F and then air cooling it to room temperature. This method controls the average size of fragments produced by the casing. Another method involves quickly quenching a warhead casing which has been heated into the austenitic temperature range. This method also controls average size. Still another method involves subjecting selected portions of a warhead casing to an environment of atmospheric hydrogen. This method controls both the size and shape of fragments. The last method described involves subjecting selected portions of a warhead casing to carburization. This method also controls both size and shape.

DESCRIPTION OF THE PREFERRED EMBODIMENT

The preferred embodiment of this invention involves the practice of certain later described techniques on warhead casings. Selection of which techniques to practice depends upon whether the warhead is to be used in armor piercing or anti-personnel applications. In the following examples, the word casing or the words warhead casing refer to tubular steel casings of the type commonly used to contain explosive charges and which have been fabricated from HF-1 steel. HF-1 is nomenclature used by Bethlehem Steel to describe a steel having a nominal composition of about 1.1% C, 1.8% Mn, .009% P, .82% Si, .015% S, .01% Al and a balance of Fe wherein the percentages are by weight.

EXAMPLE 1

A plurality of 20mm warhead casings were hardened and strengthened by austenitizing at 1750° F and then oil quenching to from about 250° F to about 150° F in an oil bath held at that temperature. After oil quenching, the casings were allowed to slowly air cool to room temperature. The thus hardened and strengthened casings were then subjected to (a) heating at temperatures in the range of from 400° F to 1200° F for periods of from about ½ hour to about 2 hours and (b) air cooling to room temperature. After this second heating and cooling process was complete, the casings were filled with explosive, sealed and placed in styrofoam containers. The styrofoam containers were then submerged in water and the explosive charges detonated after which the fragments produced by the warheads were recovered and weighed. The following data were obtained:

TABLE

| Heating Temperature | Avg. Frag. Wt. (grains) |
|---|---|
| 400° F | 0.51 |
| 500° F | 0.45 |
| 600° F | 0.41 |
| 700° F | 0.65 |
| 800° F | 0.71 |
| 900° F | 0.75 |
| 1000° F | 0.79 |
| 1100° F | 0.78 |
| 1200° F | 0.80 |

It will be noted from the table that from 1000° F to 1200° F the average fragment size leveled off into what would appear as a relatively straight line on a graph. On the other hand, a smooth decrease in average weight occurred between 400° F and 600° F and a smooth increase in average weight occurred between 600° F and 1000° F. Thus, a warhead which will produce any desired average optimum size of fragments weighing in the range of from about 0.4 to about 0.8 grains can be manufactured by selecting the correct temperature.

The tests on the particular casings of this example further revealed that the duration of the second heating time is not critical as long as temperature is maintained for a long enough period to heat the casing completely through. That is, for a 20mm casing having a wall thickness of approximately 0.2 inch, a heating time of one half hour is sufficient and a greater heating time of up to two or more hours provides neither beneficial nor detrimental effects. For casings having walls with greater thicknesses, a longer heating time would naturally be necessary in order to insure completeness of heating.

In other experiments related to the above-described tests, it was found that if the oil in the oil quenching step is held at room temperature (about 70° F) no control over the average fragment size can be achieved.

EXAMPLE 2

A plurality of 20mm casings were austenitized and oil quenched at temperatures between about 150° F and 250° F to produce strength and hardness as in Example 1. The casings were then tightly masked with plastic grids which covered and protected certain portions while leaving other portions, namely, a gridwork of bare metal exposed. The masked casings were then placed in a copper electroplating bath which deposited a thin coating of copper on the exposed grid. After this, the casings were removed from the electroplating both and the plastic grids were stripped away leaving casings having an external gridwork of copper coating and another gridwork of bare steel. The thus treated casings were then exposed to a carburizing atmosphere. It was found that the carburizing atmosphere carburized the casings only where the steel had not been coated with copper and that the carburized grid was more brittle than the copper coated grid.

When explosive filled casings of the type prepared in this example were detonated the casings fragmented primarily in the carburized gridwork and not in the copper clad gridwork. Thus, this method can be readily used to prepare casings for armor penetration type operations or, if the plastic grids used to protect portions of the casings from being electroplated are fine enough, casings suitable for anti-personnel operations can be prepared.

Any copper electroplating bath and any carburization atmosphere suitable for the type of steel used may be employed in the method of this example. While a plastic mask was used, any mask material which prevents copper from being electroplated on the covered portion of a casing is suitable.

EXAMPLE 3

A plurality of 20mm casings were austenitized at 1750° F and then quickly quenched. Quenching was accomplished in water, brine, or oil held at room temperature (about 70° F). The thus treated casings were then heated at about 1100° F for about 1 hour, air cooled to room temperature, filled with explosive, placed in styrofoam containers and detonated under water as in Example 1. Studies of the microstructure of casings treated according to the method of this example and the results obtained revealed that the quick quenching technique used produces tiny cracks in the steel which act as stress risors when explosive filled casings are detonated. The quenching rate controls the number of microcracks formed. With 20mm casings having a wall thickness of about 0.2 inch quenching in brine or water brought the casings to room temperature in less than about 1 second (a fraction of a second) while oil quenching brought the casings to room temperature in approximately 2 to 3 seconds. In other words, it was found that the average fragment size could be very closely controlled by controlling the quenching rate. Quenching in water, brine, or oil at a rate which brings the austenitized material to room temperature in a time ranging from a fraction of a second to a few seconds followed by heating to about 1100° F and air cooling produces fragments having an average weight between 0.30 and 0.70 grains. Quenching with brine produces slightly smaller fragments (about 0.30 to 0.35 grain) than does water quenching (about 0.35 to 0.39 grain), while oil quenching resulted in an average fragment size of 0.70 grain. The results obtained from this method, like those from Example 1, are consistently repeatable.

EXAMPLE 4

The method of this Example is similar to that of Example 2 in that a mask is used. To practice the method of this example an untempered casing is enveloped in a gridlike mask which protects certain portions of the surface and leaves others bare. The casing is then subjected to an environment of atomic hydrogen. Subjection to an environment of atomic hydrogen is accomplished by using the casing as a cathode in an acidic electroplating bath. In this type of operation, hydrogen ions are reduced to hydrogen atoms at the surface of the steel casing and some of the atoms diffuse into the steel. These hydrogen atoms then combine to form hydrogen molecules within the steel and create tiny voids or cracks in the microstructure. These cracks do not disappear, even when the steel is later tempered. Therefore, once the cracks have developed, the non-hydrogenated portion of a casing may be strengthened by heat treating in the normal manner (austenitization and oil quenching as in Example 1) and the remaining cracks act as internal stress risors which control the sites for fracture initiation.

It will be recognized that the process of Example 4, while being described in conjunction with steel warheads, may be used with other materials subject to cathodic charging with hydrogen. It will also be recognized that this method like that of Example 2, provides for the control of shape as well as size of fragments.

While the foregoing Examples either specifically give or imply the austenitizing temperature to be 1750° F, it should be noted that this temperature may be varied by up to ±200° F or more with the particular steels. It should also be noted that steps such as copper coating, carburization and hydrogenation may be carried out in a variety of ways. The cover used to protect portions of a casing during a copper coating or hydrogenizaton step may be fabricated from any of a number of materials capable of withstanding the pH, etc., of the electroplating bath.

I claim:

1. A method for controlling the size and shape of fragments produced by a steel warhead casing having a nominal composition of about 1.1% C, 1.8% Mn, .009% P, .82% Si, .015% S, .01% Al and a balance of Fe wherein the percentages are by weight, said method comprising the steps of:

a. masking the casing with a cover which leaves a gridwork of bare metal exposed;

b. subjecting said masked casing to an environment of hydrogen by utilizing the casing as a cathode in an acidic electroplating bath wherein hydrogen ions are reduced to hydrogen atoms at the surface of the steel casing some of which diffuse into the exposed steel casing;

c. removing said cover;

d. heating said casing to 1750° F plus or minus about 200° F to austenitize; and e. oil quenching said casing at a temperature in the range of from about 250° F to 150° F.

* * * * *